US011802370B2

(12) United States Patent
Keh et al.

(10) Patent No.: US 11,802,370 B2
(45) Date of Patent: Oct. 31, 2023

(54) METHOD FOR DECOLORIZING TEXTILES

(71) Applicant: The Hong Kong Research Institute of Textiles and Apparel Limited, Hong Kong (CN)

(72) Inventors: Edwin Yee Man Keh, Hong Kong (CN); Lei Yao, Hong Kong (CN); Hok Chung Chan, Hong Kong (CN); Sai Lung Fung, Hong Kong (CN); Un Teng Lam, Hong Kong (CN); Lap Hung Chan, Hong Kong (CN); Lee Ying Yu, Hong Kong (CN)

(73) Assignee: The Hong Kong Research Institute of Textiles and Apparel Limited, Hong Kong (CN)

( * ) Notice: Subject to any disclaimer, the term of this patent is extended or adjusted under 35 U.S.C. 154(b) by 61 days.

(21) Appl. No.: 17/249,212

(22) Filed: Feb. 24, 2021

(65) Prior Publication Data

US 2022/0267949 A1 Aug. 25, 2022

(51) Int. Cl.

| | |
|---|---|
| ***D06P 1/94*** | (2006.01) |
| ***D06P 1/16*** | (2006.01) |
| ***D06P 3/36*** | (2006.01) |

(52) U.S. Cl.
CPC ..... *D06P 1/94* (2013.01); *D06P 1/16* (2013.01); *D06P 3/36* (2013.01)

(58) Field of Classification Search
CPC ..... D06P 1/94; D06P 1/16; D06P 3/36
See application file for complete search history.

(56) References Cited

U.S. PATENT DOCUMENTS

| | | | | | |
|---|---|---|---|---|---|
| 3,980,678 | A | * | 9/1976 | Yamada | C09B 1/22 8/933 |
| 5,261,925 | A | | 11/1993 | Wasinger | |
| 6,120,554 | A | | 9/2000 | Patton et al. | |
| 2010/0281623 | A1 | | 11/2010 | Oshel et al. | |
| 2014/0068871 | A1 | | 3/2014 | Youn | |

FOREIGN PATENT DOCUMENTS

| | | | | | |
|---|---|---|---|---|---|
| CN | 1628192 | A | | 6/2005 | |
| CN | 201459424 | U | | 5/2010 | |
| CN | 104532624 | A | | 4/2015 | |
| DE | 4333221 | | * | 4/1995 | B01D 11/02 |
| JP | 3232010 | B2 | | 11/2001 | |
| JP | 2007254904 | A | | 10/2007 | |
| JP | 2009091701 | A | | 4/2009 | |
| JP | 2015048570 | A | | 3/2015 | |
| WO | WO2017/142395 | | * | 8/2017 | D06P 3/82 |

* cited by examiner

*Primary Examiner* — Amina S Khan
(74) *Attorney, Agent, or Firm* — S&F/WEHRW

(57) ABSTRACT

A method for decolorizing a dyed textile comprising a synthetic fiber and a disperse dye, the method includes contacting the dyed textile with a super critical fluid thereby extracting at least a portion of the disperse dye from the textile into the super critical fluid and forming an at least partially decolorized textile.

5 Claims, 8 Drawing Sheets

| ScCO2 feed per unit fabric (g/g) | Temperature (°C) | |
|---|---|---|
| | 90 | 130 |
| 2250 | | |
| 4500 | | |
| 6750 | | |

(Wavelength = 450 nm)

| ScCO2 feed per unit fabric (g/g) | Pressure (bar) | |
|---|---|---|
| | 140 | 240 |
| 2250 | | |
| 4500 | | |
| 6750 | | |

(wavelength = 450 nm)

| ScCO2 feed per unit fabric (g/g) | Temperature (°C) | |
|---|---|---|
| | 90 | 130 |
| 2250 |  |  |
| 4500 |  |  |
| 6750 |  |  |

(Wavelength = 530 nm)

| ScCO2 feed per unit fabric (g/g) | Temperature (°C) | |
|---|---|---|
| | 90 | 130 |
| 2250 | | |
| 4500 | | |
| 6750 | | |
| 9000 | | |
| 11250 | | |
| 13500 | | |

FIGURE 11

(Wavelength = 620 nm)

| | Original | After decolorization |
|---|---|---|
| Yellow |  |  |
| Red |  |  |
| Blue |  |  |

METHOD FOR DECOLORIZING TEXTILES

TECHNICAL FIELD

The present disclosure relates to an ecofriendly chemical approach to decolorizing textiles, such as post-consumer textiles containing polyethylene terephthalate (PET), which may using a super critical fluid, such as super critical $CO_2$ as a reusable dye extraction agent.

BACKGROUND

More than 75% of manufactured fabrics are produced using PET or PET/cotton blends. PET fabrics recycled using conventional methods retain their original colors after recovery and/or separation, and cannot be mixed or woven together to form new textiles in industry-level production processes. The color of the recycled PET is then limited and potential new applications of the recycled PET may be restricted. In order to efficiently recycle PET containing textiles for use in new textiles, decolorization of the recycled PET is necessary.

A traditional method for decolorizing recycled textiles is through the use of bleach. Fabrics made of PET or PET/cotton blends, for instance, are bleached with bleaching agents, such as sodium hypochlorite, sodium chlorite, sodium hydrosulphite, sodium formaldehyde sulfoxylate and hydrogen peroxide to eliminate the dyestuffs inside the fabric. Those bleaching agents, however, can create problems like damaging fiber structure, forming toxic chemicals, and generating large amounts of harmful effluent and exhaust.

Disperse dyes, which are commonly used for dyeing PET, are hydrophobic and embed within the PET fibers. Removing disperse dye molecules by chemical means can damage the structure as well as the integrity of the PET containing textile.

The reactive reagents used in bleaching can also produce toxic by-products containing heavy metals, carcinogens and volatile organic compounds (VOCs). The handling and disposal of these toxic by-products is costly and time consuming.

Recycling PET-containing textiles is consequently far from profitable and sustainable due in part to the poor physical performance of recycled fibers and treatment and disposal cost of waste generated in the decolorization process.

Other decolorization methods are currently applicable to extract the disperse dyes in the textile effluent only. Absorption by activated carbon, for instance, is commonly used to remove disperse dyes in wastewater.

Enzymes, fungi and microorganisms have also found use in biodegrading soluble dyestuffs in textile wastewater. Methods involving chemical reaction of dyes with ozone or semi-conductive metals have also been developed to treat dyes present in textile effluent. Such methods may be ineffective and/or unfeasible for decolorizing recycled PET.

There is thus a need to develop improved methods for decolorizing textile comprising synthetic fibers, such as PET.

SUMMARY

The present disclosure provides methods for decolorizing textiles comprising synthetic fibers, such as PET, by super critical fluid extraction. When carbon dioxide is above its critical point of 31° C. and 73 bar, it shows excellent mass transfer and penetration effect due to its low viscosity and near-zero surface tension. Without wishing to be bound by theory, it is believed that the synthetic textile fibers become "swollen" at high temperature, which allows the super critical fluid to penetrate deeply into the dyed textile fibers to dissolve and extract the dyes away from the fibers. Super critical fluids also have tunable solvent strength and density that can be modified by changing temperature or pressure. Temperature and pressure generally have positive correlations with the solubility of dyes in super critical fluids, and better decolorizing performance may be achieved at higher temperature and pressure. As most disperse dyes are non-polar, the extraction of dyes and decolorization of synthetic fibers dyed with disperse dyes is favored when using relative non-polar super critical fluids, such as super critical $CO_2$. The disperse dyes dissolved in the super critical $CO_2$ can be physically separated from the textile by the methods described herein resulting in at least the partial decolorization of the textile.

In a first aspect, provided herein is a method for decolorizing a dyed textile comprising a synthetic fiber and a disperse dye, the method comprising contacting the dyed textile with a super critical fluid thereby extracting at least a portion of the disperse dye from the textile into the super critical fluid and forming an at least partially decolorized textile.

In certain embodiments, the super critical fluid does not comprise a surfactant.

In certain embodiments, the synthetic fiber comprises a polyester, a polyamide, a polyolefin, an acrylic, an acetate, a polyurethane, or combinations thereof.

In certain embodiments, the synthetic fiber comprises polyethylene terephthalate (PET).

In certain embodiments, the disperse dye is selected from the group consisting of an acridine, an anthraquinone, an arylmethane, an azo, a cyanine, a diazonium, a nitro, a nitroso, a phthalocyanine, a quinone, an azin, an indamins, an indophenol, an oxazin, an oxazone, a thiazin, a thiazole, a xanthene, a fluorine, and combinations thereof.

In certain embodiments, the super critical fluid comprises carbon dioxide, acetone, methanol, ethanol, and propanol, and mixtures thereof.

In certain embodiments, the extraction is conducted at a temperature between 60 and 150° C.

In certain embodiments, the extraction is conducted at a temperature between 90 and 130° C.

In certain embodiments, the extraction is conducted at a pressure between 140 and 280 bar.

In certain embodiments, the extraction is conducted at a pressure between 210 and 280 bar.

In certain embodiments, the tensile strength of the at least partially decolorized textile changes by no more than 10% of the tensile strength of the dyed textile.

In certain embodiments, the super critical fluid and the textile are present in a mass ratio between 2,250:1 to 11,350:1.

In certain embodiments, the super critical fluid and the textile are present in a mass ratio between 4,500:1 to 9,000:1.

In certain embodiments, the color strength (K/S value) of the at least partially decolorized textile is at least 70% lower than the color strength (K/S value) of the dyed textile.

In certain embodiments, the supercritical fluid comprises carbon dioxide; and the extraction is conducted at a pressure between 210 and 280 bar and a temperature of between 90 and 130° C.

In certain embodiments, the super critical fluid and the textile are present in a mass ratio between 4,500:1 to 9,000:1.

In certain embodiments, the polyester comprises PET.

In certain embodiments, the method comprises contacting the dyed textile with super critical $CO_2$ at a pressure between 210 and 280 bar and a temperature of between 90 and 130° C. thereby extracting at least a portion of the disperse dye from the textile into the super critical $CO_2$ and forming an at least partially decolorized textile, wherein the dyed textile comprises PET and the super critical $CO_2$ and the textile are present in a mass ratio between 4,500:1 to 9,000:1.

In certain embodiments, the color strength (K/S value) of the at least partially decolorized textile is at least 90% lower than the color strength (K/S value) of the dyed textile.

In certain embodiments, the textile consists of PET.

Advantageously, the methods described herein do not involve any chemical reaction. As no organic solvent or harmful chemicals are required in the methods described herein, it is relatively benign and does not negatively impact the structure and physical properties of the textile fibers. Collection and recycling of the extracted disperse dyes is accomplished in a straight forward fashion, by converting the super critical fluid to gas in an e.g., separation vessel during disperse dye collection. The overall process is green and more sustainable than bleaching and other current decolorizing processes.

BRIEF DESCRIPTION OF THE DRAWINGS

The appended drawings, where like reference numerals refer to identical or functionally similar elements, contain figures of certain embodiments to further illustrate and clarify the above and other aspects, advantages and features of the present disclosure. It will be appreciated that these drawings depict exemplary embodiments and as such are not intended to limit the scope of this disclosure. The methods described herein will be described and explained with additional specificity and detail through the use of the accompanying drawings.

FIG. 11 depicts photographs showing the appearance of Sample 3 after decolorization as described in Example 4.

DETAILED DESCRIPTION

Figure 1:
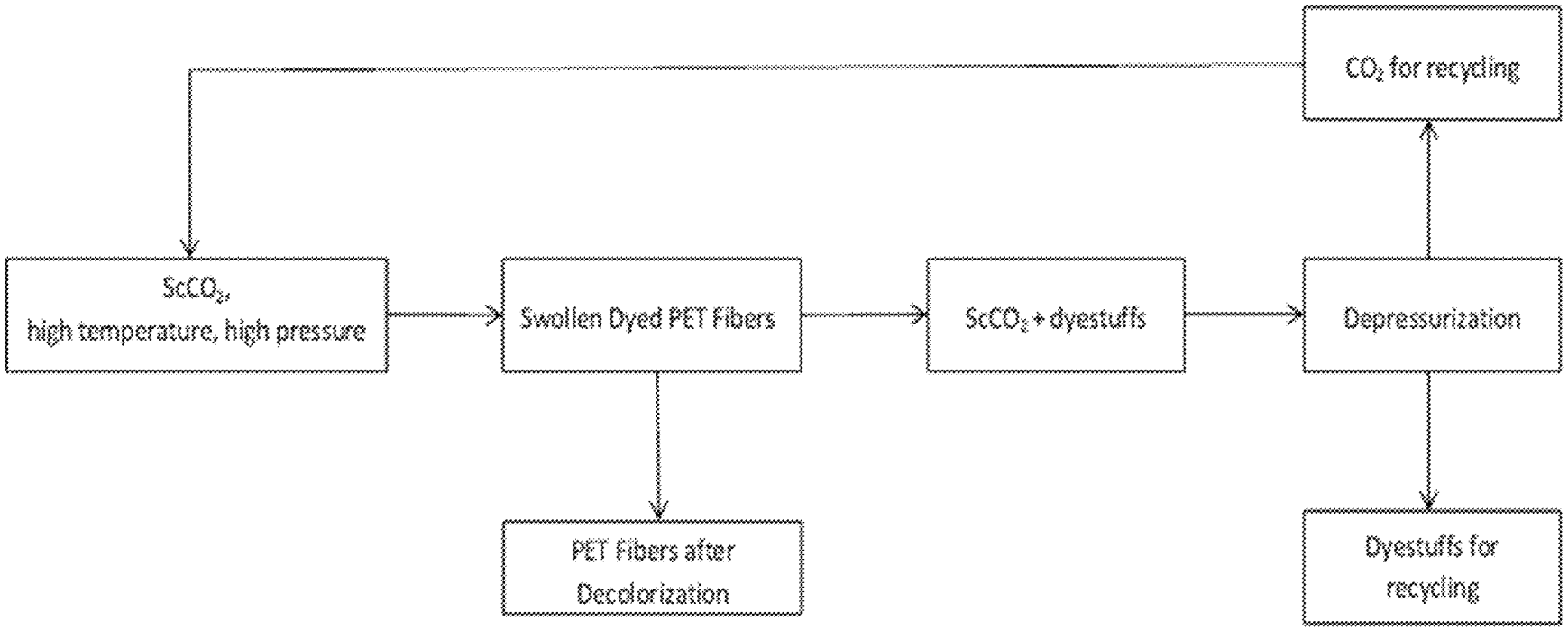
FIG. 1 depicts a flow chart illustrating an exemplary process for conducting the method described herein.

Provided herein is a method for decolorizing a dyed textile comprising a synthetic fiber and a disperse dye, the method comprising contacting the dyed textile with a super critical fluid thereby extracting at least a portion of the disperse dye from the textile into the super critical fluid and forming an at least partially decolorized textile.

The dyed textile can be individual staple fibers or filaments, yarns, fabrics, and articles (e.g., garments). Yarns may include, for instance, multiple staple fibers that are twisted together, filaments laid together without twist, filaments laid together with a degree of twist, and a single filament with or without twist. The yarn may or may not be texturized. Suitable fabrics may likewise include, for instance, woven fabrics, knit fabrics, and non-woven fabrics. Garments may be apparel and industrial garments. Fabrics and textiles may include home goods, such as linens, drapery, and upholstery (automotive, boating, airline included). The dyed textile may also be a chopped and/or flocculated fiber.

In certain embodiments, the synthetic fiber comprises a polyester, a polyamide, a polyolefin, an acrylic, modacrylic, an acetate, a polyurethane, or combinations thereof. Exemplary synthetic fibers include, but are not limited to PET, Kevlar, nomex, spandex, nylon, and the like. In certain embodiments, the synthetic fiber comprises PET. In certain embodiments, the synthetic fiber consists of PET.

The dyed textile substrate may further comprise a natural organic fiber and/or a semi-synthetic fiber.

Natural organic fibers may be of any plant or animal origin, and include, for example, those fibrous materials derived from natural products containing celluloses, such as one or more of wood, bamboo, cotton, banana, piña, hemp ramie, linen, coconut palm, soya, milk, hoya, bagasse, kanaf, retting, mudrar, silk, wool, cashmere, alpaca, angora wool, mohair, shearling, vicuña, shahtoosh, and the like.

Semi-synthetic fibers may include, for example, any one or a combination of viscose, cuprammonium, rayon, polynosic, lyocell, cellulose acetate, and the like.

In certain embodiments, the dyed textile is a blended textile substrate comprising both synthetic fibers and natural fibers, such as PET/cotton blend.

The disperse dye may be any disperse dye known to those of skill in art. The disperse dye may be an E-type, SE-type, S-type, P-type, or RD-type disperse dye. In certain embodiments, the disperse dye comprises an acridine, an anthraquinone, an arylmethane, an azo, a cyanine, a diazonium, a naphthoquinone, a nitro, a nitroso, a methine a phthalocyanine, a quinone, an azin, an indamin, an indophenol, an oxazin, an oxazone, a thiazin, a thiazole, a xanthene, a fluorine, or combinations thereof.

Exemplary disperse dyes include, but are not limited to, 1-amino-2-methylanthraquinone, Disperse red 11, Disperse blue 3, Disperse yellow 3, Disperse yellow 54, Disperse orange 13, Disperse red 54, Disperse yellow 9, Disperse orange 61, Disperse violet 28, Disperse orange 44, Disperse blue 102, Disperse violet B, Disperse red 179, Disperse orange 1, Disperse yellow 211, Disperse blue 77, Disperse red 92, Disperse blue 35, Disperse violet 26, Disperse red 91, Disperse yellow 163, Disperse red 54, Disperse red 200, Disperse yellow HG, Disperse black GI, Disperse blue 27, Supracet brilliant red BD, 2-[n-(2-cyanoethyl)-4-[(2,6-dichloro-4-nitrophenyl)azo]anilino]ethyl acetate, Disperse black 9, Disperse blue 124, Disperse violet 17, Disperse red 72, Disperse orange 5, Disperse yellow 82, Disperse yellow brown SE-4BR, Disperse brown, Disperse orange 3GL, Disperse grey BL, Disperse blue 3GR, Disperse blue 359, Disperse yellow 79, Disperse violet 63, Disperse grey N, Disperse red 1, Disperse red 60, Disperse red 4, Disperse brown 1, Disperse orange 73, Disperse black, C.I. Disperse red 50, Disperse blue 1, Disperse orange 31, Disperse red 343, Disperse blue 3G, 4-[4-(phenylazo)phenylazo]-o-cresol, Disperse blue 7, Disperse blue 93, Disperse red BFL, Disperse red 5, P-[[p-(phenylazo)phenyl]azo]phenol, C.I. Disperse yellow 71, Disperse blue 81, Disperse orange 47, Disperse red 221, Disperse red 146, Disperse yellow 56, Disperse yellow 39, Disperse red BLS, Disperse orange 288, 3-[(2-hydroxyethyl)[4-[(4-nitrophenyl)azo]phenyl]amino] propiononitrile, Disperse violet 5, Disperse blue FG, Disperse blue 281, Disperse red 17, Disperse navy blue 6G, Disperse green, Disperse brown 3R, C.I. Disperse blue A, Disperse orange 44, Disperse black 3G, Disperse black PNR, Disperse blue 5R, Disperse yellow GL, Disperse violet RB, Disperse R, Disperse black ECY, Disperse blue 72, Disperse blue 148, Disperse red 277, 3-[[2-(acetyloxy) ethyl][4-[(4-nitrophenyl)azo]phenyl]amino]propiononitrile, Disperse blue GB, Disperse red 60, Disperse violet 33, Disperse blue 54, Disperse orange 73, Disperse blue 56, Disperse orange 76, Disperse yellow 49, Disperse blue BGL, Disperse blue 183, Disperse red 65, Disperse orange 29, Disperse navy blue RE, Disperse red 2GH, Disperse black JW, Disperse yellow brown, Disperse red 17, Disperse blue BS, Disperse blue 26, Disperse yellow 104, Disperse yellow 126, Disperse yellow 64, Disperse blue 165, Disperse red 74, Disperse yellow 114, Disperse red 127, Disperse red 98, Disperse violet RN, Disperse red 73, Disperse red 13, Disperse brown 1, Disperse red 86, Disperse blue 291, Disperse violet 77, Disperse blue 143, Disperse red 53, Disperse orange 41, C.I. disperse red 50, Disperse yellow SGR, Disperse black 1, Disperse orange 29, 3-[ethyl[4-[(6-nitrobenzothiazol-2-yl)azo]phenyl]amino]propiononitrile, 1-amino-4-[(1-methylethyl)amino]anthraquinone, Disperse violet S, Disperse yellow FL, 2-[[4-[(2-cyano-3-nitrophenyl)azo]-m-tolyl](2-acetoxyethyl)amino]ethyl acetate, Disperse red 97, 2-[(2-cyanoethyl)[4-[(6-nitrobenzothiazol-2-yl)azo]phenyl]amino]ethyl acetate, Disperse violet 57, Disperse orange 45, C.I. 60752, Disperse brown 19, 2-[ethyl [3-methyl-4-[(5-nitrothiazol-2-yl)azo]phenyl]amino]ethanol, Disperse yellow 184, Disperse rubine B, Disperse violet RS, Disperse orange 25, Disperse red 153, Disperse rubine s-2GFL, 5-[(3,4-dichlorophenyl)azo]-1,2-dihydro-6-hydroxy-1,4-dimethyl-2-oxonicotinonitrile, 3-[ethyl[3-methyl-4-[(6-nitrobenzothiazol-2-yl)azo]phenyl]amino]propiononitrile, Disperse violet 96, Disperse black KSL, Disperse orange 2R, Disperse brown HRL, Disperse black GL, Disperse violet 2RB, Disperse blue 79, Disperse black rd-2BL(N), Disperse red 82, Disperse orange 30, Disperse blue 257, Disperse blue 87, Disperse yellow 3G, Disperse red 135, Disperse red 50, Disperse black 3BL, Disperse red 73, Disperse blue 106, Solvent yellow 114, Disperse red 177, Disperse blue 301, 4-hydroxy-1-methyl-3-[(3-nitrophenyl)azo]-2-quinolone, Disperse yellow 235, Disperse black BSF, Disperse yellow 2G, Disperse grass green GL, Disperse violet DP, Disperse violet 26, Disperse yellow GSL, Disperse violet 2RL, Disperse blue 60, Disperse yellow SE-FL, Disperse yellow 119, Disperse blue 284, 4-[(4-nitrophenyl)azo]benzene-1,3-diamine, 3-[[4-[(2-chloro-4-nitrophenyl)azo]phenyl]ethylamino]propiononitrile, Disperse black D-W, Disperse orange 78, Disperse dark brown BR, Disperse blue 371:1, Disperse blue H3R, Disperse anthraquinone, Disperse yellow RGFL, Disperse red RFS, Disperse black BLL, Disperse grey GMS, Disperse black SHN, Disperse orange M-G, Disperse brown BF, Disperse grey, and the like.

In certain embodiments, the disperse dye is selected from Disperse Orange 30, Disperse Red 167:1 and Disperse Blue 56, as in examples shown below.

Disperse dyes typically used for dying textiles containing synthetic fibers tend to be hydrophobic compounds with very poor solubility in polar solvents. In order to enhance the solubility of the disperse dyes in the extraction process, relatively non-polar super critical fluids may be utilized for the extraction. Exemplary super critical fluids include, but are not limited to, carbon dioxide, acetone, methanol, ethanol, propanol, and mixtures thereof. In certain embodiments, the super critical fluid is carbon dioxide.

In certain embodiments, the super critical fluid does not comprise a surfactant. In certain embodiments, the super critical fluid does not comprise a detergent. In certain embodiments, the super critical fluid does not comprise an enzyme. In certain embodiments, the super critical fluid does not comprise a noble gas.

The temperature and pressure that the disperse dye extraction is conducted is generally above the critical temperature and critical pressure of the super critical fluid. In instances in which the super critical fluid is carbon dioxide, the disperse dye extraction may be conducted at any temperature above 31° C. and any pressure above 73.8 bar.

In certain embodiments, the disperse dye extraction is conducted at a temperature between 60 and 150° C., between 70 and 150° C., between 80 and 150° C., between 80 and 140° C., between 90 and 140° C., between 90 and 130° C., between 70 and 110° C., between 80 and 100° C., between 85 and 95° C., between 110 and 150° C., between 120 and 150° C., between 120 and 140° C., or between 125 and 135° C.

In certain embodiments, the disperse dye extraction is conducted at a pressure between 140 and 280 bar, between 140 and 270 bar, between 140 and 260 bar, between 140 and 250 bar, between 140 and 240 bar, between 150 and 280 bar, between 160 and 280 bar, between 170 and 280 bar, between 180 and 280 bar, between 190 and 280 bar, between 200 and 280 bar, between 210 and 280 bar, between 220 and 280 bar, between 230 and 280 bar, between 240 and 280 bar, between 120 and 160 bar, between 130 and 160 bar, between 130 and 150 bar, between 135 and 145 bar, between 220 and 260 bar, between 230 and 260 bar, between 230 and 250 bar, or between 235 and 245 bar.

The super critical fluid and the textile may be present in any mass ratio greater than 1,000:1, greater than 2,000:1, greater than 2,250:1, greater than 4,000:1, greater than 4,500:1, greater than 6,000:1, greater than 6,750:1, greater than 8,000:1, greater than 9,000:1, greater than 10,000:1, greater than 11,250:1, greater than 12,000:1, greater than 13,000:1, or greater than 13,500:1, respectively. In certain embodiments, the super critical fluid and the textile are present in a mass ratio between 2,000:1 to 14,000:1, 4,000:1 to 14,000:1, 4,000:1 to 13,500:1, 6,000:1 to 14,000:1, 6,750:1 to 13,500:1, 8,000:1 to 14,000:1, 9,000:1 to 13,500:1, 10,000:1 to 14,000:1, or 11,250:1 to 13,500:1, respectively.

The color strength (K/S value) of the at least partially decolorized textile may be at least 50%, at least 60%, at least 70%, at least 80%, at least 90%, or at least 95% lower than the color strength (K/S value) of the dyed textile as a result of the extraction process. In certain embodiments, the color strength (K/S value) of the at least partially decolorized textile is between 50-97% lower, between 60-97% lower, between 70-97% lower, between 80-97% lower, between 90-97% lower, or between 94-97% lower than the color strength (K/S value) of the dyed textile.

The methods described herein advantageously have a minimal effect on the physical chemical, and mechanical properties of the decolorized textile enabling a broad range of recycling applications for the recovered decolorized textiles.

After the dyed textile is subjected to the decolorizing process described herein, the tensile strength across the welt of the at least partially decolorized textile may change by no more than 10%, no more than 9%, no more than 8%, no more than 7%, no more than 6%, no more than 5%, no more than 4%, no more than 3%, no more than 2%, or no more than 1% of the tensile strength of the dyed textile. In certain embodiments, the tensile strength across the welt of the at least partially decolorized textile is substantially the same as the dyed textile.

After the dyed textile is subjected to the decolorizing process described herein, the tensile strength across the warp of the at least partially decolorized textile may change by no more than 10%, no more than 9%, no more than 8%, no more than 7%, no more than 6%, no more than 5%, no more than 4%, no more than 3%, no more than 2%, or no more than 1% of the tensile strength of the dyed textile. In certain embodiments, the tensile strength across the warp of the at least partially decolorized textile is substantially the same as the dyed textile.

In certain embodiments, the decolorizing process can further comprise cycling the temperature of the super critical fluid during the step of extracting the disperse dye. The temperature cycling can reduce the temperature of the super critical fluid below the supercritical temperature and/or increases the temperature of the super critical fluid above the supercritical temperature. The temperature cycling can change the state of the super critical fluid from a supercritical fluid to a state where at least a part of the super critical fluid is not in supercritical fluid state. The temperature cycling may also facilitate the generation of bubbles.

In certain embodiments, the decolorizing process can include generating bubbles in the presence of the dyed textile during the disperse dye extraction.

In certain embodiments, the decolorizing process can include agitating the dyed textile. The agitating can be from mechanical agitation with a stirring mechanism, spinning mechanism, or a washing mechanism similar to a traditional washing machine.

The decolorizing process can further comprise removing the super critical fluid and the extracted disperse dyes from the at least partially decolorized textile. The super critical fluid and disperse dyes can be removed continuously by removing a feed of super critical fluid containing the dispersed dye from the decolorizing vessel during the decolorizing process, and wherein the super critical fluid can be optionally introduced into the decolorizing vessel to maintain the amount of supercritical fluid in the decolorizing vessel. Alternatively, the decolorizing process can be operated on a batch basis, wherein the supercritical fluid and disperse dyes are removed after the decolorizing process is complete. In certain embodiments, the same dyed textile can undergo multiple cycles of decolorizing with fresh super critical fluid, which is removed, and then replaced for each decolorizing cycle.

In certain embodiments, the decolorizing process further comprises separating the super critical fluid from the extracted disperse dyes after being removed from the decolorizing vessel.

In certain embodiments, the decolorizing process can further comprise recycling the super critical fluid for additional decolorizing cycles of the same or different dyed textiles. The recycling process can comprise cooling the super critical fluid to a liquid state after being separated from the disperse dye. The liquid can then be stored in a storage vessel before being used again or converted to a supercritical fluid.

In certain embodiments, the decolorizing process can further comprise converting the super critical fluid to a gas after being separated from the disperse dyes. The recycling process can thus further comprise converting the gas to a supercritical fluid before being used again in another decolorizing process.

In certain embodiments, the decolorizing process can further comprise introducing the supercritical fluid into a decolorizing vessel; introducing the dyed textile into the decolorizing vessel; and extracting the dyed textile with the supercritical fluid within the decolorizing vessel. Accordingly, the gas or liquid can be converted into a supercritical fluid before being introduced into the decolorizing vessel. Alternatively, the gas or liquid can be converted to a supercritical fluid within the decolorizing vessel. In certain embodiments, the dyed textile is introduced into the decolorizing vessel before the super critical fluid or its liquid or gaseous precursor is introduced.

EXAMPLES

In the examples mentioned below, PET fabrics sample(s) are rolled into a porous beam and the beam is then fixed into a cylindric decolorizing vessel. Heating of decolorizing vessel is controlled electrically.

Super critical $CO_2$ feed is compressed by pressurizing pump and it is then flow into the decoloring vessel. Super critical $CO_2$ then contact with PET fabrics and remove the dyestuff. Super critical $CO_2$ and dissolved dyestuff flow out from decoloring vessel through porous beam. Super critical $CO_2$ and dissolved dyestuff final depressurized by depressurization device and flow through separating vessel to perform separation.

Example 1

Figure 2:
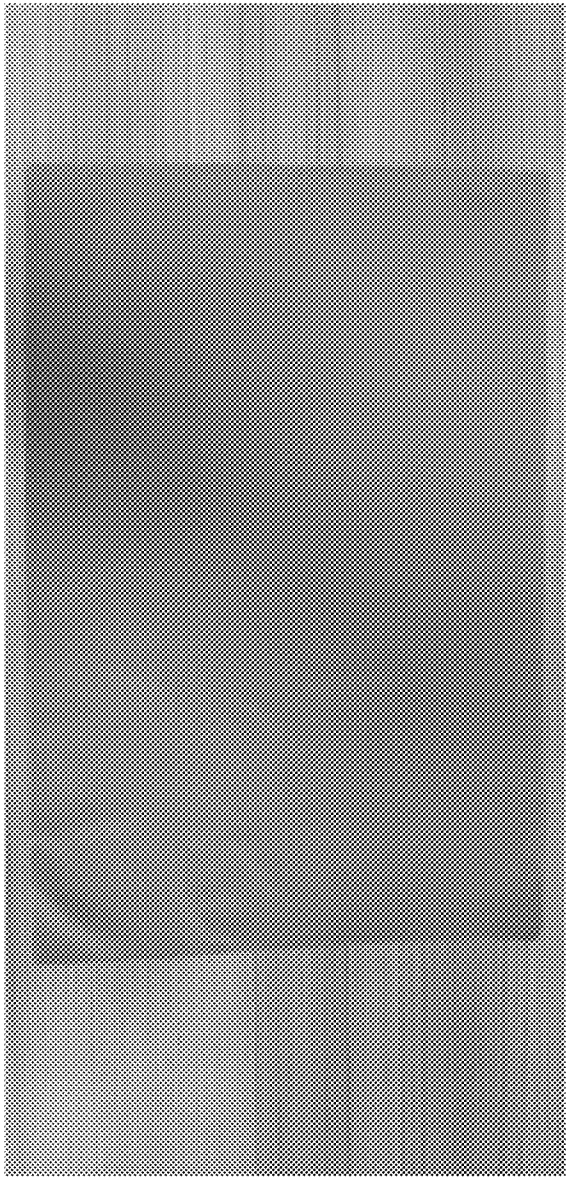
FIG. 2 depicts a photograph showing the appearance of original Sample 1.
Figures 3, 4:
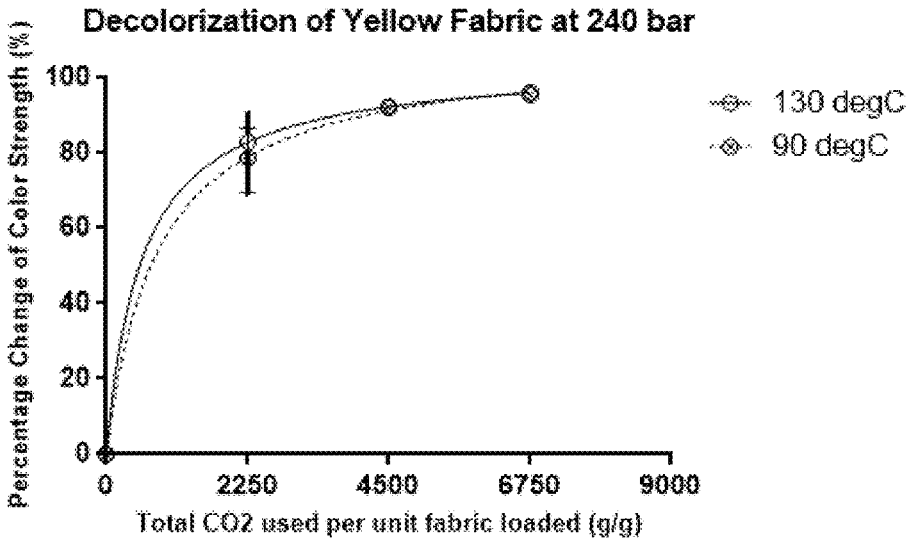
FIG. 3 depicts photographs showing the appearance of Sample 1 after decolorization as described in Example 1.
FIG. 4 depicts the decolorization kinetics in Example 1.

10 g of samples of 100% PET fabrics with yellow color Disperse Orange 30 (Sample 1, shown in FIG. 2), which have original maximum wavelength of 450 nm, was placed into the decolorizing system with process step shown in FIG. 1. The operating temperature ranged from 90° C. to 130° C., and the pressure is in 240 bar. Super critical $CO_2$ fed per unit gram of fabric is ranged from 2250 g/g to 6750 g/g. The decolored samples appearances are shown in FIG. 3. The K/S values of the sample before and after decolorization were measured. The detailed results are listed in Table 1 and decolorization kinetics is shown in FIG. 4.

TABLE 1

Percentage Change of Color Strength of Sample 1 Decolorization at Different Temperature and super critical $CO_2$ Fed, 240 bar Pressure.

| $ScCO_2$ feed | Temperature (° C.) | | | | | |
|---|---|---|---|---|---|---|
| | 90 | | | 130 | | |
| per unit fabric (g/g) | Average | Maximum | Minimum | Average | Maximum | Minimum |
| 0 | 0 | 0 | 0 | 0 | 0 | 0 |
| 2250 | 78.7 | 86.7 | 69.5 | 83.0 | 91.1 | 68.5 |
| 4500 | 92.4 | 93.6 | 91.3 | 92.1 | 94.2 | 90.9 |
| 6750 | 95.6 | 96.9 | 94.0 | 96.1 | 96.3 | 95.6 |

Besides, tearing strength (ASTM D1424) had been tested for the change in tensile strength after maximum super critical $CO_2$ fed. The detailed results are listed in Table 2.

TABLE 2

Percentage Change of Tensile Strength of Sample 1 Decolorization after maximum super critical $CO_2$ fed at Different Temperature, 240 bar Pressure.

| | Temperature (° C.) | | | |
|---|---|---|---|---|
| $ScCO_2$ feed | 90 | | 130 | |
| per unit fabric (g/g) | Across Warp | Across Welt | Across Warp | Across Welt |
| 0 | 0 | 0 | 0 | 0 |
| 6750 | −6.7 | 0 | −6.7 | −8.3 |

Example 2

Figures 5, 6:
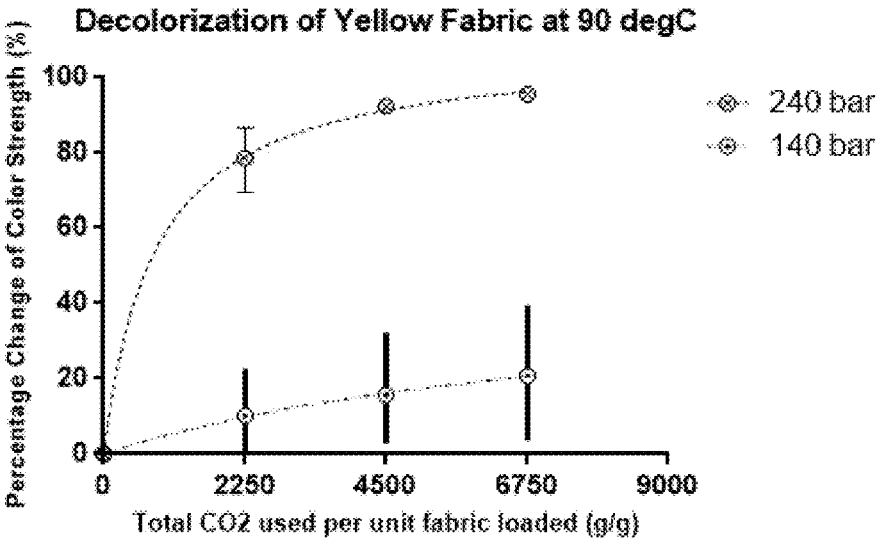
FIG. 5 depicts photographs showing the appearance of sample 1 after decolorization in Example 2.
FIG. 6 depicts the decolorization kinetics in Example 2.

10 g of samples of 100% PET fabrics with yellow color Disperse Orange 30 (Sample 1, shown in FIG. 2), which have original maximum wavelength of 450 nm, was placed into the decolorizing system with process step shown in FIG. 1. The operating temperature is in 90° C., and the pressure ranged from 140 bar to 240 bar. Super critical $CO_2$ fed per unit gram of fabric is ranged from 2250 g/g to 6750 g/g. The decolored samples appearances are shown in FIG. 5. The K/S values of the sample before and after decolorization were measured. The detailed results are listed in Table 6 and decolorization kinetics is shown in FIG. 6.

TABLE 3

Percentage Change of Color Strength of Sample 1 Decolorization at Different Pressure and super critical $CO_2$ Fed, 90° C. Temperature.

| | Pressure (bar) | | | | | |
|---|---|---|---|---|---|---|
| $ScCO_2$ feed | 140 | | | 240 | | |
| per unit fabric (g/g) | Average | Maximum | Minimum | Average | Maximum | Minimum |
| 0 | 0 | 0 | 0 | 0 | 0 | 0 |
| 2250 | 10.2 | 22.6 | 0.6 | 78.7 | 86.7 | 69.5 |
| 4500 | 15.7 | 32.2 | 2.9 | 92.4 | 93.6 | 91.3 |
| 6750 | 20.8 | 39.4 | 3.7 | 95.6 | 96.9 | 94.0 |

Besides, tearing strength (ASTM D1424) had been tested for the change in tensile strength after maximum super critical $CO_2$ fed. The detailed results are listed in Table 4.

TABLE 4

Percentage Change of Tensile Strength of Sample 1 Decolorization after maximum super critical $CO_2$ fed at Different Pressure, 90° C. Temperature.

| | Pressure (bar) | | | |
|---|---|---|---|---|
| $ScCO_2$ feed | 140 | | 240 | |
| per unit fabric (g/g) | Across Warp | Across Welt | Across Warp | Across Welt |
| 0 | 0 | 0 | 0 | 0 |
| 6750 | 0 | 0 | −6.7 | 0 |

Example 3

Figure 7:
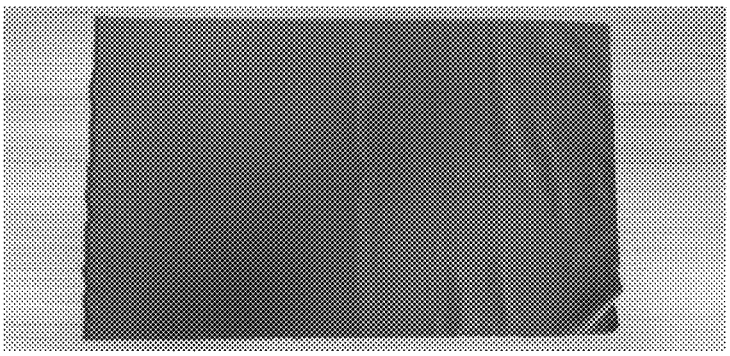
FIG. 7 depicts a photograph showing the appearance of original Sample 2.
Figure 8:
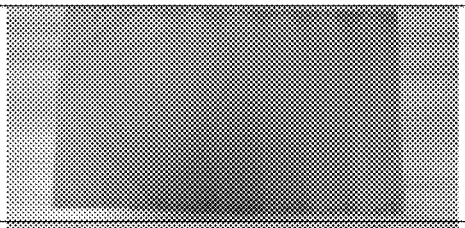
FIG. 8 depicts photographs showing the appearance of Sample 2 after decolorization as described in Example 3.
Figure 8:
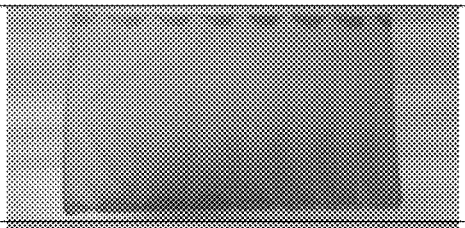
Figure 8:
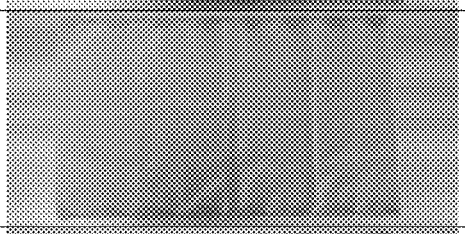
Figure 8:
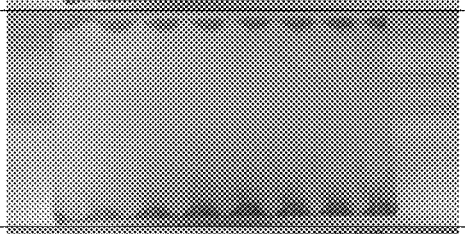
Figure 8:
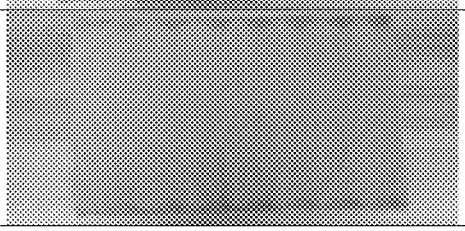
Figure 8:
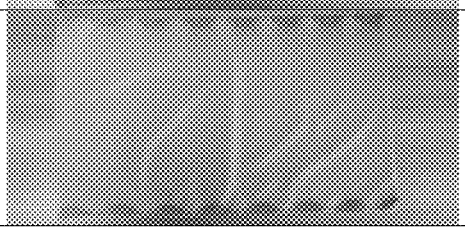
Figure 9:
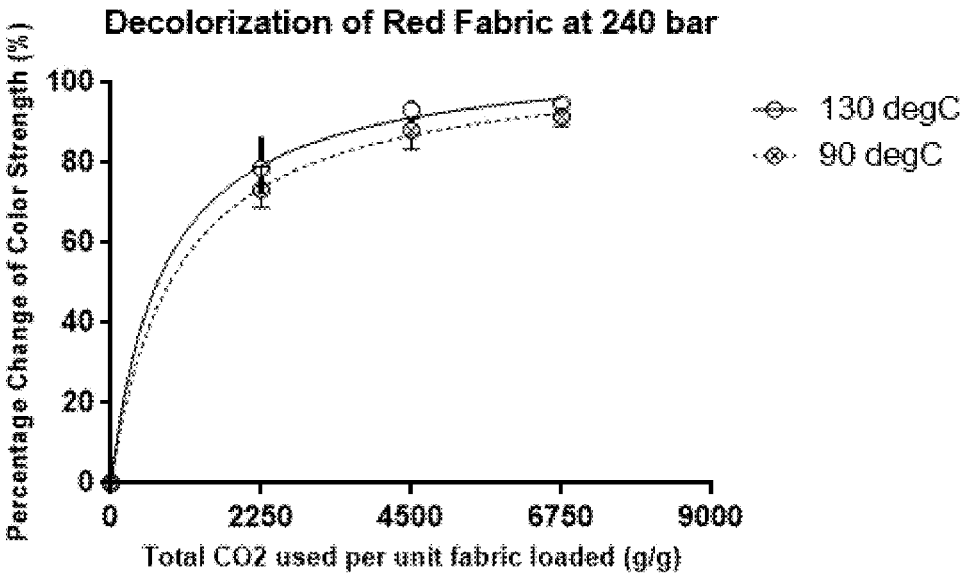
FIG. 9 depicts the decolorization kinetics in Example 3.

10 g of samples of 100% PET fabrics with red color Disperse Red 167:1 (Sample 2, shown in FIG. 7), which have original maximum wavelength of 530 nm, was placed into the decolorizing system with process step shown in FIG. 1. The operating temperature ranged from 90° C. to 130° C., and the pressure is in 240 bar. super critical $CO_2$ fed per unit gram of fabric is ranged from 2250 g/g to 6750 g/g. The decolored samples appearances are shown in FIG. 8. The K/S values of the sample before and after decolorization were measured. The detailed results are listed in Table 5 and decolorization kinetics is shown in FIG. 9.

TABLE 5

Percentage Change of Color Strength of Sample 2 Decolorization at Different Temperatures and super critical $CO_2$ Fed, 240 bar Pressure.

| | Temperature (° C.) | | | | | |
|---|---|---|---|---|---|---|
| $ScCO_2$ feed | 90 | | | 130 | | |
| per unit fabric (g/g) | Average | Maximum | Minimum | Average | Maximum | Minimum |
| 0 | 0 | 0 | 0 | 0 | 0 | 0 |
| 2250 | 73.3 | 79.0 | 68.8 | 78.7 | 86.6 | 72.1 |
| 4500 | 88.1 | 91.1 | 83.4 | 93.2 | 95.6 | 90.1 |
| 6750 | 91.6 | 93.5 | 89.2 | 94.8 | 96.1 | 93.0 |

Besides, tearing strength (ASTM D1424) had been tested for the change in tensile strength after maximum super critical $CO_2$ fed. The detailed results are listed in Table 6.

TABLE 6

Percentage Change of Tensile Strength of Sample 2 Decolorization after maximum super critical $CO_2$ fed at Different Temperatures, 240 bar Pressure.

| | Temperature (° C.) | | | |
|---|---|---|---|---|
| $ScCO_2$ feed | 90 | | 130 | |
| per unit fabric (g/g) | Across Warp | Across Welt | Across Warp | Across Welt |
| 0 | 0 | 0 | 0 | 0 |
| 6750 | 0 | 0 | −6.3 | 0 |

Example 4

Figure 10:
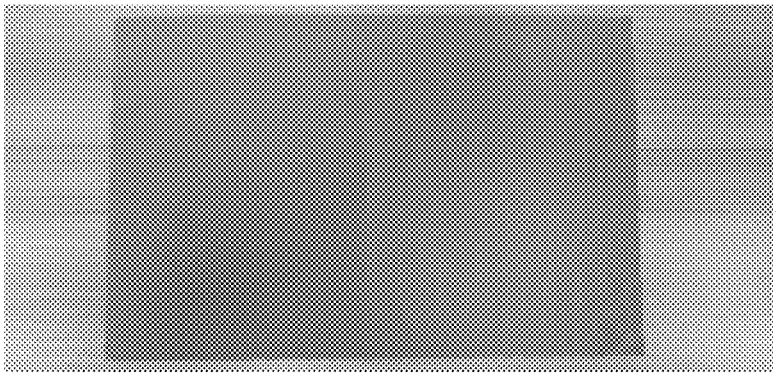
FIG. 10 depicts a photograph showing the appearance of original Sample 3.
Figure 12:
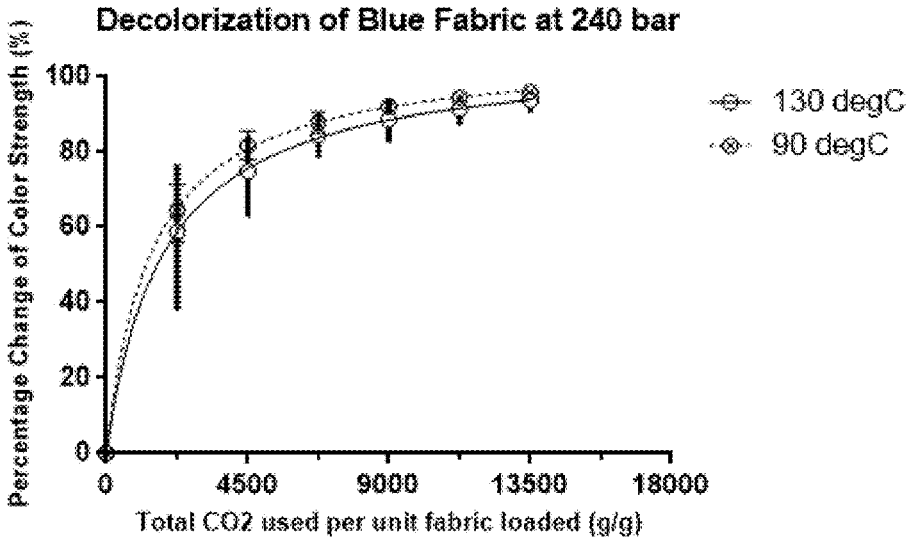
FIG. 12 depicts the decolorization kinetics in Example 4.

10 g of samples of 100% PET fabrics with blue color Disperse Blue 56 (Sample 3, shown in FIG. 10), which have original maximum wavelength of 620 nm, was placed into the decolorizing system with process step shown in FIG. 1. The operating temperature ranged from 90° C. to 130° C., and the pressure is in 240 bar. Super critical $CO_2$ fed per unit gram of fabric is ranged from 2,250 g to 11,350 g. The decolored samples appearances are shown in FIG. 11. The K/S values of the sample before and after decolorization were measured. The detailed results are listed in Table 7 and decolorization kinetics is shown in FIG. 12.

TABLE 7

Percentage Change of Color Strength of Sample 3 Decolorization at Different Temperatures and super critical $CO_2$ Fed, 240 bar Pressure,

| $ScCO_2$ feed per unit fabric (g/g) | Temperature (° C.) 90 Average | 90 Maximum | 90 Minimum | 130 Average | 130 Maximum | 130 Minimum |
|---|---|---|---|---|---|---|
| 0 | 0 | 0 | 0 | 0 | 0 | 0 |
| 2250 | 64.4 | 71.4 | 56.0 | 58.9 | 77.0 | 37.9 |
| 4500 | 81.8 | 85.7 | 78.1 | 74.9 | 84.6 | 62.7 |
| 6750 | 88.0 | 90.7 | 85.1 | 84.4 | 90.1 | 78.4 |
| 9000 | 92.1 | 93.6 | 90.1 | 88.6 | 93.9 | 82.5 |
| 11250 | 94.6 | 95.6 | 93.3 | 91.6 | 94.5 | 87.2 |
| 13500 | 95.9 | 96.5 | 95.0 | 93.8 | 96.2 | 90.4 |

Besides, tearing strength (ASTM D1424) had been tested for the change in tensile strength after maximum super critical $CO_2$ fed. The detailed results are listed in Table 8.

TABLE 8

Percentage Change of Tensile Strength of Sample 3 Decolorization after maximum $ScCO_2$ fed at Different Temperatures, 240 bar Pressure.

| $ScCO_2$ feed per unit fabric (g/g) | Temperature (° C.) 90 Across Warp | 90 Across Welt | 130 Across Warp | 130 Across Welt |
|---|---|---|---|---|
| 0 | 0 | 0 | 0 | 0 |
| 11350 | 0 | 0 | 0 | 0 |

Example 5

Figure 13:
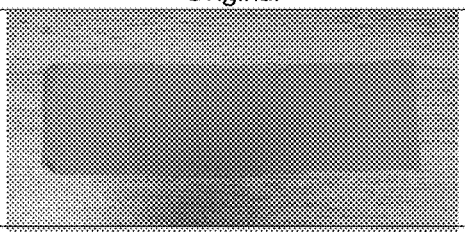
FIG. 13 depicts the appearance of three PET samples before and after decolorization in Example 5.
Figure 13:
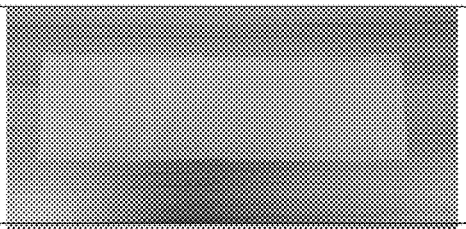
Figure 13:
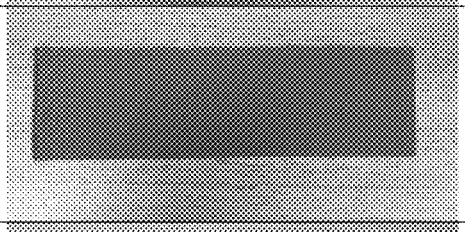
Figure 13:
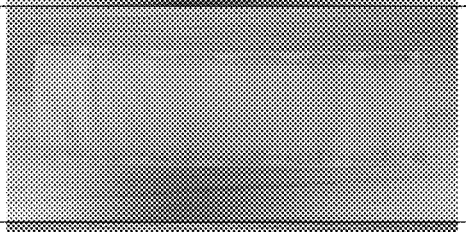
Figure 13:
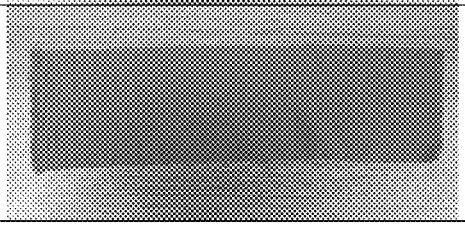
Figure 13:
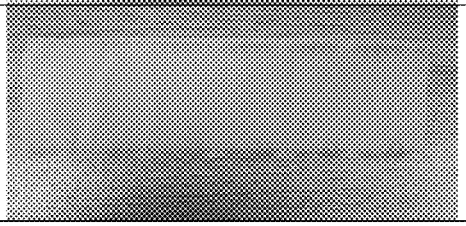

9 g of mixed samples with colors of Disperse Orange 30, Disperse Red 167:1 and Disperse Blue 56 (Sample 4, shown in FIG. 13) were placed into the decolorizing system with process step shown in FIG. 1. The samples involve 3 g of 100% PET fabrics with yellow color (original maximum wavelength=450 nm), 3 g of 100% PET fabrics with red color (original maximum wavelength=530 nm), and 3 g of 100% PET fabrics with blue color (original maximum wavelength 620 nm). The operating temperature is in 90° C., and the pressure is in 240 bar. Super critical=$CO_2$ fed per unit gram of fabric is in 9,000 g. The decolored samples appearances are shown in FIG. 13. The K/S values of the sample before and after decolorization were measured. The detailed results are listed in Table 9.

TABLE 9

Percentage Change of Color Strength of Sample 4 Decolorization.

| $ScCO_2$ feed per unit fabric (g/g) | Components Yellow Average | Yellow Maximum | Yellow Minimum | Red Average | Red Maximum | Red Minimum | Blue Average | Blue Maximum | Blue Minimum |
|---|---|---|---|---|---|---|---|---|---|
| 0 | 0 | 0 | 0 | 0 | 0 | 0 | 0 | 0 | 0 |
| 9000 | 97.8 | 97.9 | 97.7 | 96.4 | 97.2 | 95.5 | 93.3 | 95.3 | 91.0 |

Besides, tearing strength (ASTM D1424) had been tested for the change in tensile strength after maximum super critical $CO_2$ fed. The detailed results are listed in Table 8.

TABLE 10

Percentage Change of Tensile Strength of Sample 4 Decolorization.

| $ScCO_2$ feed per unit fabric (g/g) | Components Yellow Across Warp | Yellow Across Welt | Red Across Warp | Red Across Welt | Blue Across Warp | Blue Across Welt |
|---|---|---|---|---|---|---|
| 0 | 0 | 0 | 0 | 0 | 0 | 0 |
| 9000 | 0 | 0 | −6.3 | 0 | 0 | 8.3 |

The present disclosure is not to be limited in terms of the particular embodiments described in this application, which are intended as illustrations of various aspects. Many modifications and variations can be made without departing from its spirit and scope, as will be apparent to those skilled in the art. Functionally equivalent processes within the scope of the disclosure, in addition to those enumerated herein, will be apparent to those skilled in the art from the foregoing descriptions. Such modifications and variations are intended to fall within the scope of the appended claims. The present disclosure is to be limited only by the terms of the appended claims, along with the full scope of equivalents to which such claims are entitled. It is to be understood that this disclosure is not limited to particular methods, reagents, compounds compositions or biological systems, which can, of course, vary. It is also to be understood that the terminology used herein is for the purpose of describing particular embodiments only, and is not intended to be limiting.

What is claimed is:

1. A method for decolorizing a dyed textile comprising polyethylene terephthalate (PET) and a disperse dye, the method consisting of contacting the dyed textile with a super critical fluid consisting of carbon dioxide at a pressure between 210 and 280 bar and a temperature of between 90 and 130° C. thereby extracting at least a portion of the disperse dye from the textile into the super critical fluid and forming an at least partially decolorized textile, wherein the super critical $CO_2$ and the textile are present in a mass ratio between 4,500:1 to 9,000:1 and the tensile strength of the at least partially decolorized textile changes by no more than 10% of the tensile strength of the dyed textile.

2. The method of claim 1, wherein the disperse dye is selected from the group consisting of an acridine, an anthraquinone, an arylmethane, an azo, a cyanine, a diazonium, a nitro, a nitroso, a phthalocyanine, a quinone, an azin, an indamins, an indophenol, an oxazin, an oxazone, a thiazin, a thiazole, a xanthene, a fluorine, and combinations thereof.

3. The method of claim 1, wherein the dyed textile and the at least partially decolorized textile have a color strength (K/S value) and the color strength (K/S value) of the at least partially decolorized textile is at least 70% lower than the color strength (K/S value) of the dyed textile.

4. The method of claim 1, the dyed textile and the at least partially decolorized textile have a color strength (K/S value) and wherein the color strength (K/S value) of the at least partially decolorized textile is at least 90% lower than the color strength (K/S value) of the dyed textile.

5. The method of claim 1, wherein the textile consists of PET.

* * * * *